US007804033B2

(12) United States Patent
Dianin et al.

(10) Patent No.: US 7,804,033 B2
(45) Date of Patent: Sep. 28, 2010

(54) DISCONNECTOR FOR AN ELECTRICAL SUBSTATION HANDLING VOLTAGES IN EXCESS OF 1100KV

(75) Inventors: Ferruccio Dianin, Saccolongo (IT); Stefano Dessanti, Noventa Di Piave (IT); Sergio Serafin, Noventa Di Piave (IT)

(73) Assignee: Areva T&D S.P.A., Noventa Di Piave (IT)

( * ) Notice: Subject to any disclaimer, the term of this patent is extended or adjusted under 35 U.S.C. 154(b) by 551 days.

(21) Appl. No.: 11/904,996

(22) Filed: Sep. 28, 2007

(65) Prior Publication Data

US 2008/0093204 A1 Apr. 24, 2008

(30) Foreign Application Priority Data

Sep. 28, 2006 (EP) ..... 06425665

(51) Int. Cl.
*H01H 31/00* (2006.01)

(52) U.S. Cl. ..... 200/48 CB; 200/48 R

(58) Field of Classification Search ..... 200/48 CB, 200/48 R

See application file for complete search history.

(56) References Cited

U.S. PATENT DOCUMENTS 1,784,735 A 12/1930 Lawson
3,009,995 A 8/1958 Turgeon
3,293,387 A * 12/1966 Foti ..... 200/48 CB

FOREIGN PATENT DOCUMENTS

| | | |
|---|---|---|
| CH | 334101 | 12/1958 |
| DE | 9010170 | 10/1990 |
| FR | 2590073 | 5/1997 |

OTHER PUBLICATIONS

French Search Report, EP 06425665 (Feb. 2, 2007) pp. 4.
Translation of CH 334101; 1 pg., Sep. 15, 1956.
Literature SOP Knee-Type Disconnector 245 to 800 kV; of FR 2590073; 4 pgs.

* cited by examiner

*Primary Examiner*—Renee S Luebke
*Assistant Examiner*—Vanessa Girardi
(74) *Attorney, Agent, or Firm*—Nixon Peabody LLP

(57) ABSTRACT

The present invention is mainly directed to a disconnector for an electrical substation for very high voltage in excess of 1100 kV, of the horizontal displacement type comprising a first moving part (2) and a second moving part (4), the said first moving part (2) and second moving part (4) each comprising at least two articulated arms (14, 16, 114, 116) which are arranged to make contact with each other through a free end. In the closed position, which is the closed position of the disconnector, the first arms (14, 114) and the second arms (16, 116) of each of the moving parts together define a non-flat angle (α) so that they form an arch, the two second arms (16, 116) being aligned with each other in a substantially horizontal position.

11 Claims, 4 Drawing Sheets

DISCONNECTOR FOR AN ELECTRICAL SUBSTATION HANDLING VOLTAGES IN EXCESS OF 1100KV

CROSS-REFERENCE TO RELATED PATENT APPLICATION OR PRIORITY CLAIM

This application claims the benefit of a Europe Patent Application No. 06-425 665.4, filed on Sep. 28, 2006, in the Europe Intellectual Property Office, the disclosure of which is incorporated herein in its entirety by reference.

DESCRIPTION

Technical Field and Prior Art

The present invention relates to a disconnector for an electrical substation, working with alternating current (AC) at a very high voltage in excess of 1100 kilovolts (kV), and it also relates to an electrical substation including such a disconnector.

A very high voltage electrical substation comprises, in particular, a circuit breaker and a disconnector, the circuit breaker being interposed between two busbars for carrying alternating current at very high voltage, and the disconnector being interposed between the circuit breaker and one of the busbars.

The disconnector in an electrical substation has a safety operation, in that it is opened after the circuit breaker has been opened, thus ensuring safety for any activity taking place in the substation.

In the present state of the art, the very high voltage is below 800 kV, so that the disconnector is required to open with a gap of the order of 5 meters (m) to 6 m in order to avoid any arcing.

That type of interrupter for an electrical substation of 800 kV is generally of the vertical displacement type as described in the document CH 334 101. The disconnector is of the pantograph type consisting of two elongate and articulated parallelograms which fold up in order to open the disconnector.

Horizontal displacement disconnectors also exist, comprising two arms that are articulated to each other, with one of the arms being pivoted on an insulating support. The two arms are aligned with each other when the disconnector is in its closed position. The length of the two arms is then from 5 m to 6 m when they are aligned in the closed position.

When the voltage is of the order of 1100 kV, the opening distance required is of the order of 10 m to 12 m. The disconnectors of the present state of the art are therefore no longer suitable.

In this connection, the moving elements of the disconnector would have dimensions and weights such that it cannot be conceived that vertical displacement could achieve opening with an opening distance of 12 m, as the disconnector would run the risk of buckling in the closed position. In order to avoid this, it would therefore be necessary to stiffen the pantograph, which would increase the weight and the size of the moving elements and the physical size of the disconnector.

In addition, the insulating supports are made of ceramic or of composite material, having mechanical characteristics that are not suitable for supporting such weights.

For a disconnector with vertical displacement, having two articulated arms that are aligned in the closed position, the risks of buckling are again very high. The stresses imposed by the external environment, such as wind and ice, must also be taken into consideration.

It could be envisaged that two vertical displacement disconnectors, as in the present state of the art, might be connected in series. The gap of 10 m to 12 m could be achieved in this way. However, that solution requires the provision of a central electrode of large dimensions. The total size of the electrical substation would then be much larger than 12 m.

Moreover, voltage distribution performance is inferior to that in disconnectors in the present state of the art. Voltage distribution is also due to capacitive coupling, which depends on the partial capacitance towards the central electrode.

It is consequently an object of the present invention to offer a disconnector for an electrical substation working at very high voltage of the order of 1100 kV.

A further object of the present invention is to offer a disconnector for a very high voltage (1100 kV) electrical substation having good voltage distribution performance, limited size, and stability when in the closed position.

SUMMARY OF THE INVENTION

The object set forth above is achieved by a disconnector for a very high voltage electrical substation, comprising two articulated members each of which is fixed to an insulating support, and which are adapted to make contact with each other in order to close the disconnector, the said members being such that, in the closed position, the two arms constituting each of the articulated members define a non-flat angle between them.

In other words, the disconnector has two half-pantographs that are arranged to come into contact with each other, the two half-pantographs being in engagement against each other. In the operation of closing the disconnector, the half pantographs are not fully deployed, so that the segments of the half-pantographs that are pivotally mounted on the insulating supports have the effect of stiffening the disconnector.

Buckling is thus avoided and resistance to accidental damage is improved.

In addition, since the half-pantographs are not fully deployed, the displacement of elements of large size and heavy weight is made easier.

Accordingly, the present invention mainly provides a disconnector for an electrical substation working at very high voltages in excess of 1100 kV, of the horizontal displacement type having a first moving part mounted movably on a first insulating support, and a second moving part mounted movably on a second insulating support, the said first and second moving parts each comprising a first arm and a second arm articulated relative to each other, the first arms being mounted on the respective insulating supports by a first longitudinal end, the second arms being arranged to make contact with each other through a second longitudinal end, wherein, with the disconnector in its closed position, the first arm and the second arm of each of the moving parts together define a non-flat angle so that they form an arch, the two second arms being aligned with each other in a substantially horizontal position.

The expressions "moving part" and "articulated member" are used interchangeably.

In the closed position, the first arms are preferably inclined upwardly towards each other, whereby to be subjected to a compressive force.

In a folded position, each of the moving parts is in a folded position, and the first arm and second arm may be substantially parallel to each other in a vertical position, thus enabling the required opening distance, or gap, of the disconnector to be obtained with reduced overall size.

In one example of an embodiment, the angle (α) may be in the range 135° to 150°.

The opening distance between the free ends of the moving parts that are to make contact with each other is in the range 10 m to 12 m.

For example, the length of the first arm is in the range 3.5 m to 4 m, and the length of the second arm is in the range 3.8 m to 4.2 m.

Preferably, the two moving parts are symmetrical relative to a vertical plane, which simplifies manufacture of the disconnector.

The present invention also provides an electrical substation for very high voltage of the order of 1100 kV, which comprises at least one disconnector in accordance with the present invention.

BRIEF DESCRIPTION OF THE DRAWINGS

The present invention can be understood more clearly in the light of the following description and the attached drawings, in which.

DETAILED DESCRIPTION OF PARTICULAR EMBODIMENTS

Figure 1:
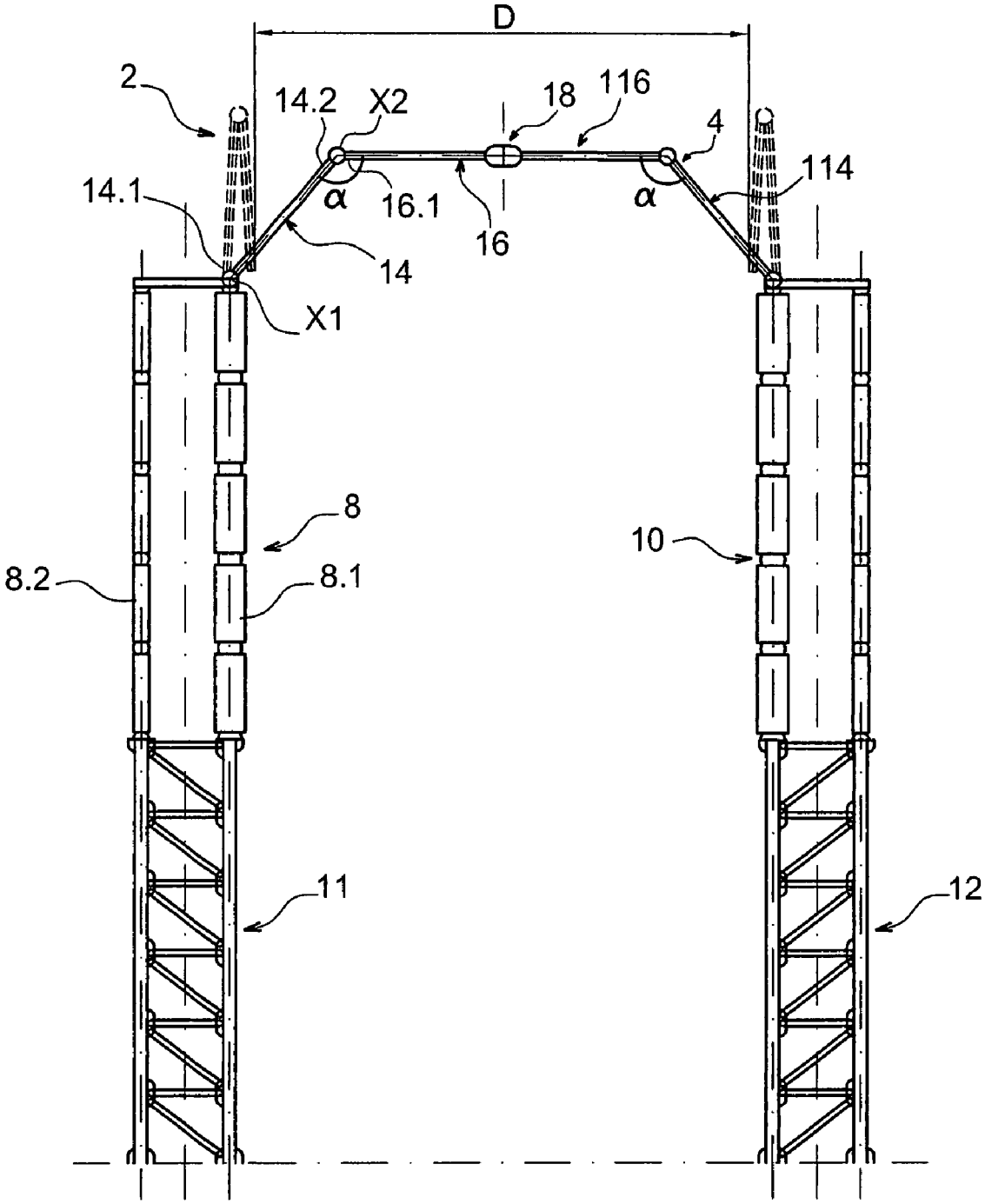
FIG. 1 is a diagrammatic front view of a disconnector in accordance with the invention, shown in its closed position.

FIG. 1 shows, in its closed position, a disconnector in accordance with the present invention. It comprises two articulated members, or moving parts, namely a first articulated member 2 and a second articulated member 4, together with insulating supports 8 and 10, with each of the articulated members 2 and 4 being mounted pivotally on one of the insulating supports 8, 10 respectively.

The insulating supports consist of two supports 8.1, 8.2, 10.1, 10.2 respectively. The support elements 8.1 and 10.1 effectively constitute a vertical support for the articulated members 2 and 4, while the support elements 8.2 and 10.2, besides being a vertical support, constitute a connecting rod for controlling the deployment of the articulated members 2 and 4.

The insulating supports 8 and 10 are themselves disposed on metal structures 11 and 12 respectively, thereby forming pylons.

The pylons are separated from each other by a distance D which is approximately equal to 10 m to 12 m, corresponding to the opening distance, or gap, that is required for the very high voltage disconnector of the present invention.

The first articulated member 2 is described below in detail, the second member 4 being identical to the first articulated member 2.

In the example shown, the first articulated member 2 comprises a first arm 14, secured by means of a first longitudinal end 14.1 to the insulating support 8 through a pivoted connection, together with a second arm 16 which is secured at a first longitudinal end 16.1, by means of a pivot, to a second longitudinal end 14.2 of the first arm 14.

The first articulated arm comprises a first arm 114 attached to the insulating support 10, and a second arm 116.

Thus the first arm 14 is rotatable about a fixed axis X1 that is orthogonal to the plane of the drawing sheet, while the second arm 16 is rotatable about an axis X2 that is orthogonal to the plane of the drawing sheet, being movable in the plane of that sheet.

By way of example, the first arm 14 can measure 3.5 m to 4 m in length, while the second arm 16 can measure 3.8 m to 4.2 m in length.

The first and second articulated members 2 and 4 constitute half-pantographs, the operation and use of which are well known to the person skilled in the field of electrical disconnectors. For example, FR 1 204 754 describes an example of a mechanism for deploying such a half-pantograph.

Figure 5:
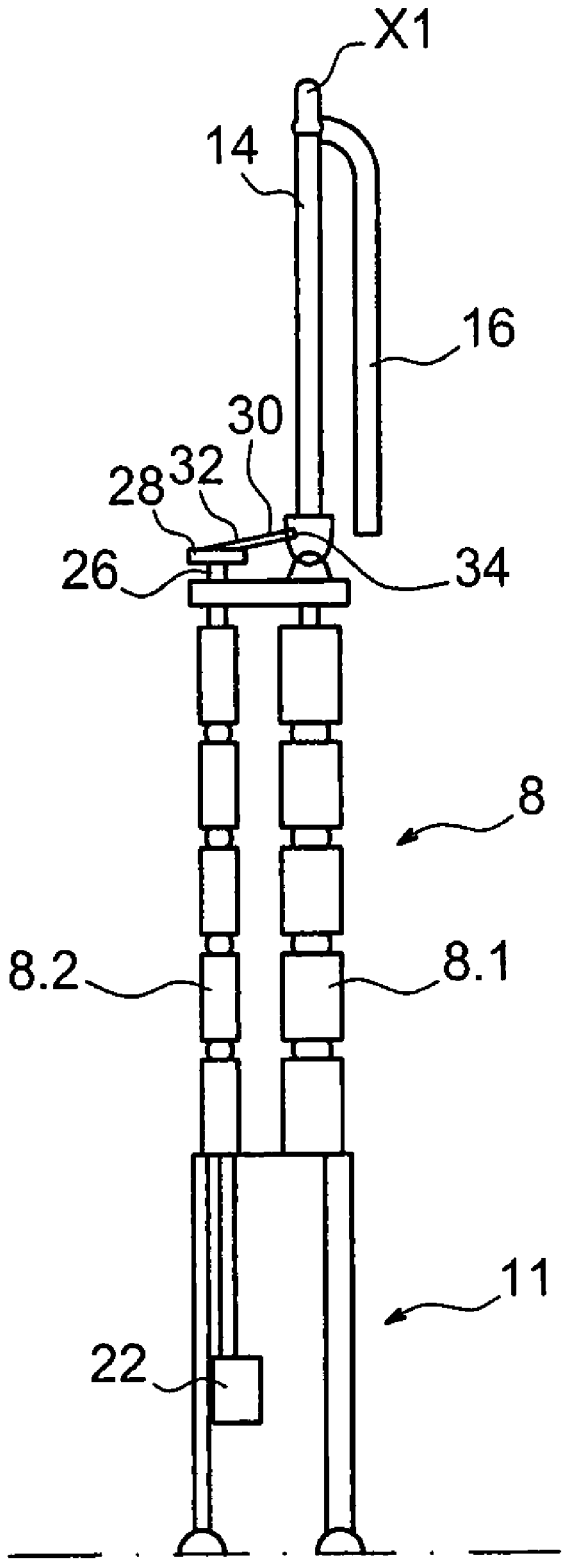
FIG. 5 is a diagrammatic version of FIG. 1.

FIG. 5 shows a pylori in accordance with the present invention in detail. In it, there can be seen the control rod 8.2 which is incorporated in the insulating support 8 and which is actuated from a mechanism in a casing 22 disposed in a lower part of the pylori. The control rod 8.2 actuates in its turn, through a cardan coupling 26, a crank 28 fixed to the cardan 26. Between the crank 28 and the first arm 14, there is fixed a connecting rod 30 that is movable in all planes by virtue of articulations 32 and 34.

When the control rod 8.2 is rotated in a clockwise direction, the crank 28 rotates clockwise through a given angle. The first arm 14 is then moved by the connecting rod 30 and comes into a position which is inclined relative to the horizontal. During this movement, the second arm 16 rotates about the axis X1 and comes into a horizontal position. At the end of this movement the disconnector is closed, as shown in FIG. 1.

Opening of the disconnector is achieved in the manner opposite to closing, for example, by rotating the control rod anticlockwise.

The first and second articulated members 2 and 4 are arranged to be electrically connected together through their free ends by means of a connector 18.

The connector 18 may be identical with the connector described in the document FR 2 590 073, which comprises a male contact carried by one of the articulated members 2, 4 and a female contact carried by the other one of the articulated members 4, 2. The connector 18 is particularly well adapted to severe icing conditions, since the male and female contacts are protected.

During deployment of the articulated members 2 and 4, the male and female contacts are automatically aligned with each other, the male contact then penetrating into the female contact.

In accordance with the present invention, in the deployed position the articulated members take up the form of an arch, which increases the rigidity of the disconnector.

In particular, the second arm 16 forms an angle α with the first arm 14, by contrast with disconnectors in the present state of the art in which the first and second arms are aligned with each other.

In the example here shown, the disconnector then has, in its closed position, the form of an isosceles trapezium, in which the minor base comprises the two second arms 16 and 116 of the first and second articulated members 2 and 4. The second articulated members 2 and 4 are in engagement against each other at the level of the connector 18.

The angle α is preferably in the range 135° to 150°. The smaller the angle α, the more the movement of the movable arms 14 and 16 is facilitated during the operation of opening the disconnector, so that functional feasibility is obtained at reasonable cost. In addition, the angle α cannot be too large because, when the disconnector is in its closed position, it is preferable to arrange for a free horizontal stroke in order to take into account any possible displacements of the pylons 8-11, 10-12.

Figure 2:
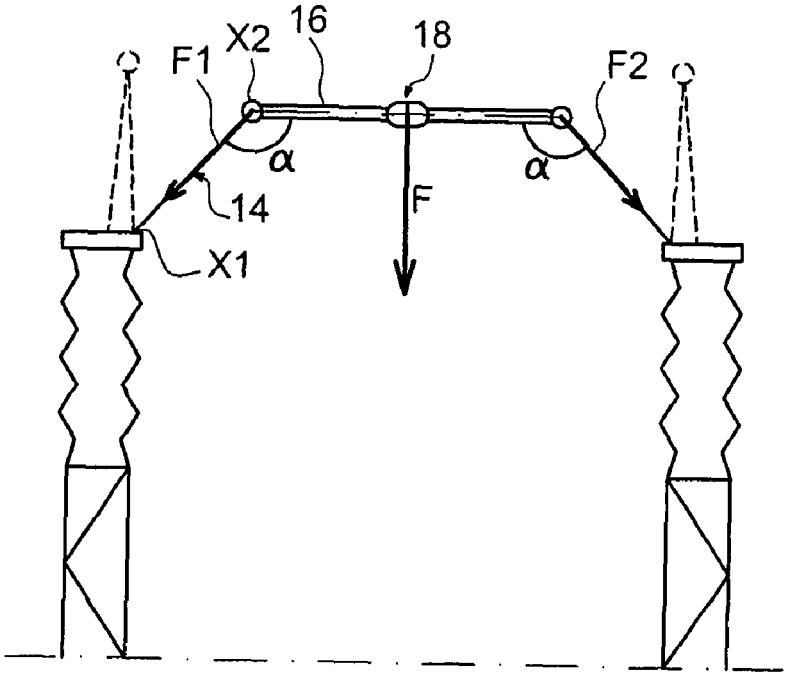
FIG. 2 is a diagram of the disconnector shown in FIG. 1, and shows the forces to which the disconnector is subjected.

FIG. 2 is a diagrammatic view of the disconnector in which the weight distribution is shown.

The force F that results from the weight of the disconnector is applied vertically downwards. By means of the present invention, the force F is divided into two forces F1 and F2, the direction of which is that of the first arms 14 and 114 of each of the articulated members, which are then subjected respectively to a compressive force directed towards the insulating supports 8 and 10, and this ensures a stable position for the disconnector.

Figure 3:
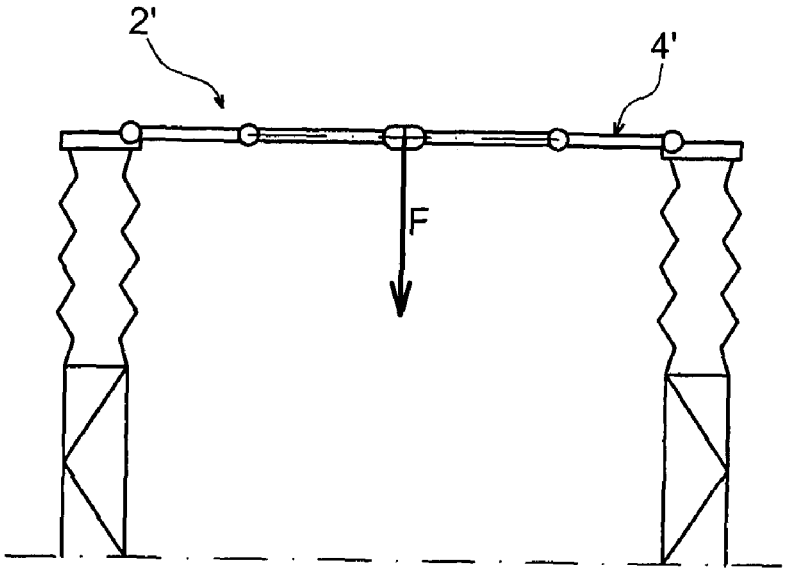
FIG. 3 is a diagram of a disconnector of the aligned type that is unable to function correctly, and is given for purposes of comparison.

By contrast, FIG. 3 shows diagrammatically a disconnector in which the two articulated members 2' and 4' are aligned with each other in the closed position. The force F is then exerted only in the vertical downward direction. No force is taken by the insulating supports. This configuration is very sensitive to external influences such as wind and ice. Moreover, mechanical stability cannot be ensured.

In addition, because the articulated arms are both outstretched, their free ends carrying the male and female contacts are unable to be guided in any reliable manner. There is accordingly a very substantial danger that the male contact will fail to meet the female contact.

By contrast, by means of the present invention each of the articulated members 2 and 4 has rigidity during the connection process, thus enabling the contacts to be guided with precision, which guarantees that connection will be made every time.

FIG. 1 shows in broken lines the articulated members 2 and 4 folded in the open position of the disconnector. The articulated members are in line with the respective insulating supports, in a vertical position. This vertical configuration enables the opening distance of 12 m to be ensured with reduced physical size. As to this, if the articulated members 2 and 4 were inclined towards each other, it would be necessary to put the pylons more than 12 m apart, in order to achieve an effective opening distance of 12 m for the disconnector.

FIGS. 4A to 4F show a deployment sequence for an articulated member in accordance with the present invention.

Figure 4A:
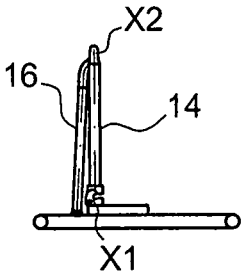
FIGS. 4A to 4F are views of a closing sequence in a disconnector according to the invention.

In FIG. 4A, the articulated member 2 is folded up, with the first arm 14 and second arm 16 substantially parallel to each other.

Figure 4B:
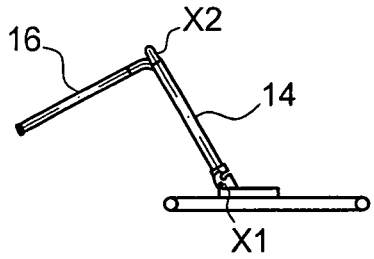
Figure 4C:
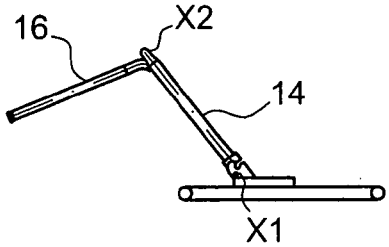
Figure 4D:
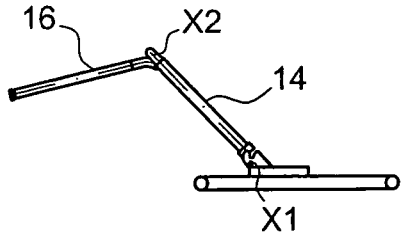

In FIGS. 4B to 4D, the second arm 16 is pivoting about the axis X2 and is moving away from the first arm 14, while at the same time the first arm 14 is pivoting about the axis X1, lining up until it is substantially at right angles to the insulating support 8.

Figure 4E:
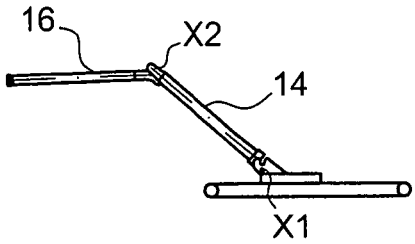
Figure 4F:
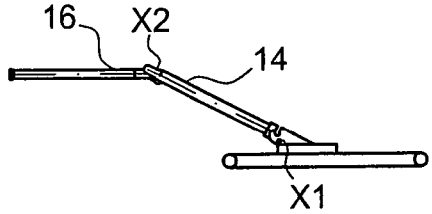

Then, in FIGS. 4E and 4F, the first arm 14 is pivoting about the axis X1 and is inclined towards the second articulated segment, the second arm 16 continuing at the same time to pivot while moving away from the first arm 14 until it reaches the angled position shown in FIG. 4F, in which the second arm 16 is in a substantially horizontal position.

When the angle $\alpha$ is equal to 135°, the first arm 14 performs a rotation of 45° about the axis X1 relative to a vertical plane, while the second arm 16 performs a rotation of 90° about the axis X2 relative to the vertical plane.

The above description has been given with articulated members having two arms, but disconnectors having articulated members with three arms or more do not depart from the scope of the present invention.

The operation of closing the disconnector of the present invention is described below.

When it is required to close the disconnector while the circuit breaker is in its open position, each insulating support 8 or 10 pivots round, causing the respective articulated members 2 and 4 to unfold in the sequence which is illustrated by FIGS. 4A to 4F. The arms 104 are set in motion, for example, in the way described above.

The deployment operation takes place in such a way that the male contact lines up with the female contact and penetrates into it at the end of the deployment sequence, with the two articulated members then being in engagement against each other.

The disconnector is opened by folding the articulated members in a reversal of the closing sequence shown in FIGS. 4A to 4F.

In the example shown in FIG. 1, the two articulated members are symmetrical, but it is possible to provide asymmetrical members in which the second arm of the first articulated member is longer than that of the second articulated member.

The disconnector of the present invention therefore offers high stability in its closed position and accurate guiding of the male and female contacts, in particular over a distance greater than 10 m.

What is claimed is:

1. A horizontal displacement type disconnector for an electrical substation working at very high voltages in excess of 1100 kV, having a first moving part mounted movably on a first insulating support, and a second moving part mounted movably on a second insulating support, the said first and second moving parts each comprising a first arm and a second arm articulated relative to each other, the first arms being mounted on the respective insulating supports by a first longitudinal end, the second arms being arranged to make contact with each other through a second longitudinal end, wherein, with the disconnector in its closed position, the first arm and the second arm of each of the moving parts together define a non-flat angle so that they form an arch, the two second arms being aligned with each other in a substantially horizontal position.

2. A disconnector according to claim 1, in which, in the closed position, the first arms are inclined upwardly towards each other, whereby to be subjected to a compressive force.

3. A disconnector according to claim 1, wherein, in a folded position, each of the moving parts is in a folded position, the first arm and second arm being substantially parallel to each other in a vertical position.

4. A disconnector according to claim 1, in which, in the closed position, the first arms are inclined upwardly towards each other, whereby to be subjected to a compressive force, and in a folded position, in which the disconnector is opened, each of the moving parts is in a folded position, the first arm and second arm being substantially parallel to each other in a vertical position.

5. A disconnector according to claim 1, in which the angle is in the range 135° to 150°.

6. A disconnector according to claim 1, wherein the opening distance between the free ends of the moving parts that are to make contact with each other is in the range 10 m to 12 m.

7. A disconnector according to claim 1, wherein the length of the first arm is in the range 3.5 m to 4 m, and the length of the second arm is in the range 3.8 m to 4.2 m.

8. A disconnector according to claim 1, wherein the two moving parts are symmetrical relative to a vertical plane.

9. An electrical substation for very high voltage of the order of 1100 kV, including at least one horizontal displacement type disconnector having a first moving part mounted movably on a first insulating support, and a second moving part mounted movably on a second insulating support, the said first and second moving parts each comprising a first arm and a second arm articulated relative to each other, the first arms being mounted on the respective insulating supports by a first longitudinal end, the second arms being arranged to make contact with each other through a second longitudinal end, wherein, with the disconnector in its closed position, the first arm and the second arm of each of the moving parts together define a non-flat angle so that they form an arch, the two second arms being aligned with each other in a substantially horizontal position.

10. An electrical substation for very high voltage of the order of 1100 kV, according to claim 9, in which the opening distance between the free ends of the moving parts that are to make contact with each other is in the range 10 m to 12 m.

11. An electrical substation for very high voltage of the order of 1100 kV according to claim 10, wherein the length of the first arm is in the range 3.5 m to 4 m, and the length of the second arm is in the range 3.8 m to 4.2 m, and the angle is in the range 135° to 150°.

* * * * *